United States Patent [19]

Horgan

[11] Patent Number: 4,951,856

[45] Date of Patent: Aug. 28, 1990

[54] PEN PACK

[76] Inventor: Gary A. Horgan, 214 Newton St., Waltham, Mass. 02154

[21] Appl. No.: 331,648

[22] Filed: Mar. 30, 1989

[51] Int. Cl.[5] ..... A45C 11/34; B43K 31/00

[52] U.S. Cl. ..... 224/218; 224/196; 224/197; 224/245; 224/219; 401/8; 401/95

[58] Field of Search ..... 224/162, 196, 197, 199, 224/245, 200, 242, 217–221, 267; 401/6–8, 95

[56] References Cited

U.S. PATENT DOCUMENTS

| | | | |
|---|---|---|---|
| 1,577,272 | 3/1926 | Treadaway | 224/219 |
| 1,797,103 | 3/1931 | Rustad | 401/8 |
| 1,970,399 | 8/1934 | Shatkin | 401/95 |
| 2,793,617 | 3/1957 | Palmer | 224/221 |
| 2,926,631 | 3/1960 | Palmer | 224/221 |
| 3,075,498 | 1/1963 | Udcoff | 401/8 |
| 3,503,546 | 3/1970 | Hunt | 224/218 |
| 4,678,356 | 7/1987 | Garland | 401/95 |

*Primary Examiner*—Henry J. Recla
*Assistant Examiner*—Casey Jacyna
*Attorney, Agent, or Firm*—Weingarten, Schurgin, Gagnebin & Hayes

[57] ABSTRACT

A pen pack is disclosed which is mountable on the back of the writing hand of a user to provide ready access to a writing, marking or scribing implement when required. The pen pack includes a telescopic writing implement and an actuating mechanism disposed in a casing which may be readily affixed to the wearer's hand. The actuating mechanism includes a plunger which is depressed against an external object to actuate the pen pack, a feeder line subassembly which coacts with the plunger, and a rotational shaft which also coacts with the plunger and to which the telescopic writing instrument is affixed. Depression of the plunger causes the telescopic writing instrument to rotate into a writing position. Concomitantly, the feeder line subassembly causes the telescopic writing instrument to be extended to a fully telescoped position so that the user may grip the writing instrument and utilize it for writing, marking or scribing. The feeder line subassembly also includes a retraction mechanism which causes the telescopic writing instrument to be returned to its original position when the user releases the telescopic writing instrument.

12 Claims, 8 Drawing Sheets

PEN PACK

FIELD OF THE INVENTION

The present invention is directed to implements for writing, marking and/or scribing, and more particularly, to a pen pack which includes a telescopic writing instrument mountable on the back of a user's hand and which is readily actuatable to position the telescopic writing instrument for use and to retract the writing instrument to a nonuse position.

BACKGROUND OF THE INVENTION

Almost everyone at one time or another has experienced the inconvenience of requiring a writing instrument for a particular task and finding that a writing instrument is not at hand. Such inconvenience is particularly telling for people whose jobs require them to write, mark or scribe frequently, but who also are required to have the free use of their hands at other times for non-writing tasks.

One way to ensure that a writing implement is readily at hand is to store the writing implement on the user's person, as for example, storing the writing implement in a pocket of the user's clothing or tucking the writing implement behind an ear. Many workers, however, may not have clothing suitable for keeping a writing instrument readily handy. For example, construction or industrial workers frequently wear T-shirts without pockets and secretaries and other female clerical personnel often wear dresses without pockets of any sort.

And, some writing instruments have a configuration or bulk which makes it awkward to tuck the writing implement behind one's ear. In a similar vein, the wearing of glasses would preclude tucking the writing implement behind one's ear.

Another possible way to ensure that a writing implement is readily at hand is to position the writing implement at the work station. We have all experienced Murphy's Law, however, and it always seems that a writing implement once laid down is soon mislaid. In addition, a worker may be required to move around such that a previously positioned writing implement may not always be handy.

SUMMARY OF THE INVENTION

A pen pack is disclosed which overcomes the disadvantages of loose writing implements by providing instant access to a writing implement at those times when a writing implement is required. The pen pack according to the present invention is inexpensive, lightweight and configured for mounting on the back of the user's writing hand. While providing ready access to a writing implement, the pen pack of the present invention also permits the wearer to have free use of his hands for other tasks.

The pen pack of the present invention includes a pen pack casing, a means for mounting the pen pack casing on the back of the user's hand, a telescopic writing, marking or scribing means, and a means for actuating the pen pack to provide the wearer with instant access to the writing implement when required. The pen pack also includes a retracting means for returning the writing implement to its original position when use thereof is not required, thereby freeing the wearer's hands for other tasks.

The writing means of the present invention includes a writing instrument mounted in a telescopic member.

The writing implement for use in the present invention may include various instruments such as pencils, felt-tipped pens, crayons, paint brushes, grease pencils, styluses or the like which may be used to writing, marking or scribing upon a wide variety of objects.

The actuating means, which is housed within the pen pack casing, includes a plunger, a feeder line subassembly, and a rotational shaft. The feeder line subassembly and the rotational shaft coact with and are activated by the plunger. The writing means is secured to the rotational shaft.

The wearer activates the pen pack by causing the plunger to be depressed, thereby causing the writing means to be rotated to a writing position by means of the rotational shaft so that the wearer can easily grip the writing means for subsequent use. Concomitantly, depression of the plunger operates the feeder line subassembly which causes the writing means to telescope whereby the wearer may easily grip the writing means for subsequent use in writing, marking or scribing.

The actuating means of the present invention also includes means for retracting the writing means into its original position with respect to the pen pack casing, thereby freeing the wearer's hands for other tasks. The retracting means provides a biasing force which rotates the telescopic writing means to its original position and concomitantly causes the writing instrument to be retracted to an untelescoped position. In one embodiment, the retraction means is a helical spring which coacts with the feeder line subassembly to provide retraction of the writing means when the wearer releases his grip on the writing means. In another embodiment, the retraction means is a coiled spring which coacts with the rotational shaft to provide retraction of the writing means when the wearer releases his grip on the writing means.

BRIEF DESCRIPTION OF THE DRAWINGS

A more complete understanding of the present invention and the attendant advantages and features thereof will be more readily understood by reference to the following detailed description when considered in conjunction with the accompanying drawings wherein.

DETAILED DESCRIPTION OF PREFERRED EMBODIMENTS

Figure 1A:
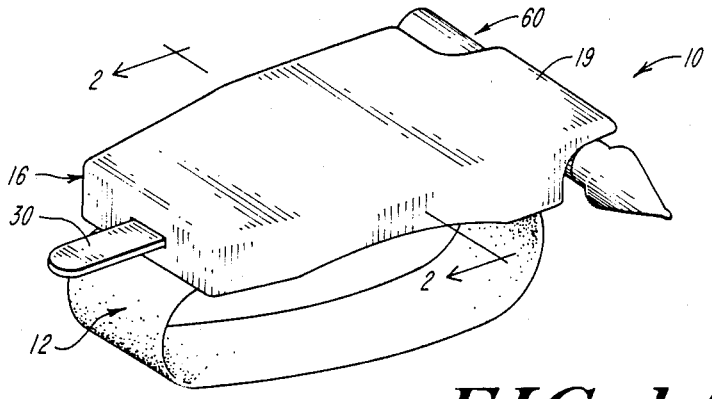
FIGS. 1A, 1B are a perspective views of a pen pack according to the present invention with the writing means illustrated in the retracted and extended positions, respectively.
Figure 1B:
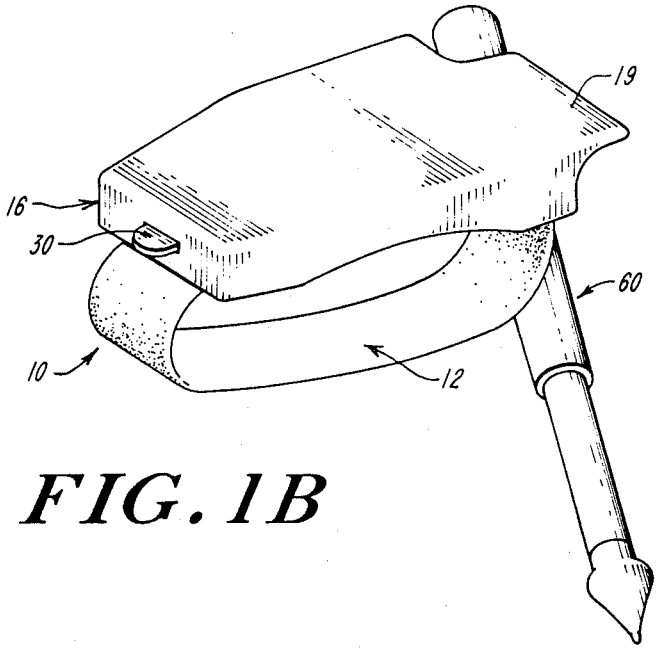

Referring now to the drawings wherein like reference numerals designates corresponding or similar elements throughout the several views, FIGS. 1A, 1B are perspective views of a pen pack 10 according to the present invention. The pen pack 10 is mountable on the back of the writing hand of the user. The pen pack 10 includes a means 12 such as an adjustable strap for mounting the pen pack 10 on the back of the hand, a pen pack casing 16, an actuating mechanism which includes a plunger 30, a feeder line subassembly 40, and a rotational shaft 50, and a telescoping means 60 for writing, marking or scribing.

The pen pack casing 16 includes an upper casing member 17 and a lower casing member 18. The upper and lower casing members 17, 18 are configured to be secured together by any conventional means such as latches to form the pen pack casing 16. The lower casing member 18 may be configured to conform to the back of the hand, thereby facilitating mounting of the pen pack 10 thereto. The pen pack casing members 17, 18 may be formed by any conventional fabrication technique, for example, molding. The pen pack casing members 17, 18 may be fabricated from a variety of materials such as conventional plastics, high impact plastics, elastomers and metals.

The upper casing member 17 includes a shield 19 integrally formed therewith and depending from one side thereof. The shield 19 protects the writing means 60 to prevent it from being damaged by inadvertent contact with external objects when the wearer is using his hands for non-writing tasks. A retainer 20 may be integrally formed with the lower casing member 18 to depend therefrom on the side opposite the shield 19. The retainer 20 is configured to engage the edge of the hand upon which the pen pack is mounted to preclude movement of the pen pack 10 when the plunger 30 is depressed. Alternatively, a portion of the mounting means 12 may be rigidly formed to perform this function.

Figure 2:
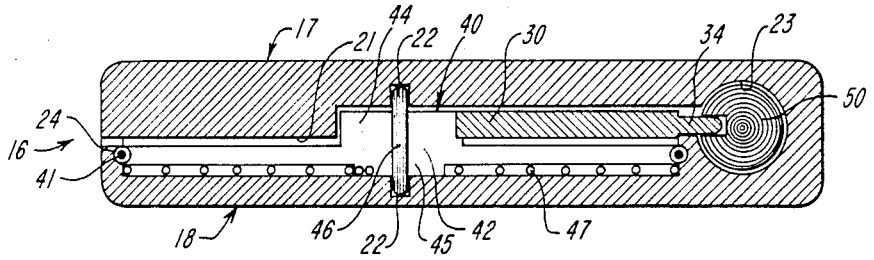
FIG. 2 is a cross-sectional view of the pen pack of FIG. 1 taken along line 2—2 thereof.

Referring to FIG. 2, the upper and lower casing members 17, 18 are internally formed to define a chamber 21 for housing the plunger 30 and the feeder line subassembly 40, corresponding wells 22 for mounting the feeder line subassembly 40 for rotational movement within the chamber 21, a cylindrical channel 23 for housing the rotational shaft 50, a semicircular feeder line groove 24 circumscribing the chamber 21 and a feeder line channel 25 extending outwardly from the chamber 21 to the edge of the pen pack casing 16 adjacent the writing means 60. A stop flange 26 is formed in the cylindrical channel 23 to engage the rotational shaft 50 to prevent linear movement thereof.

Figure 3A:
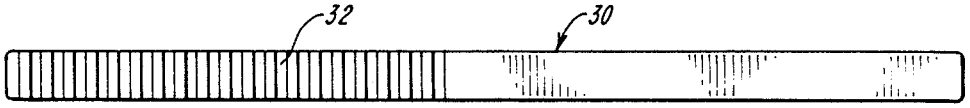
FIGS. 3A, 3B, 3C are plan views of a plunger for the pen pack of FIG. 1.
Figure 3B:
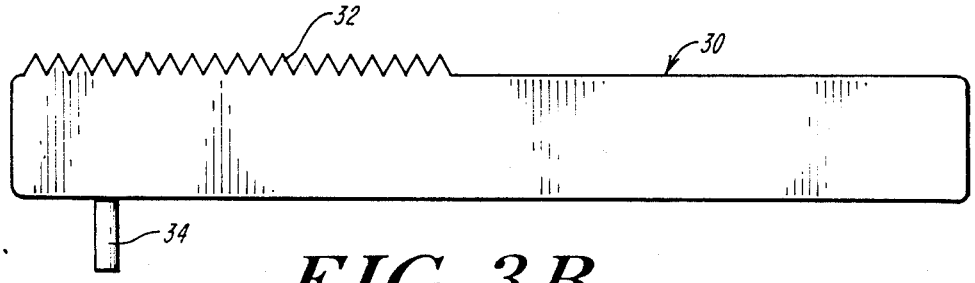
Figure 3C:
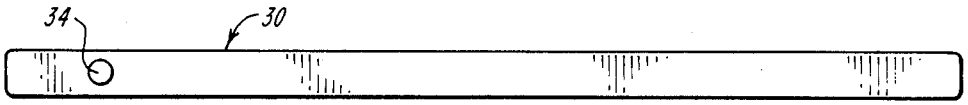

Three plan views of an exemplary plunger 30 are depicted in FIGS. 3A, 3B, 3C. The plunger 30 has a generally rectangular, flat elongated configuration and includes a plurality of teeth 32 and a plunger pin 34 at one end thereof. The end portion of the plunger 30 containing the teeth 32 and the pin 34 is disposed within the chamber 21 of the casing 16. The other end of the plunger 30 depends outwardly of the casing 16 so that a force may be exerted thereon to activate the pen pack 10 whereupon the wearer may utilize the writing means 60.

Figure 4A:
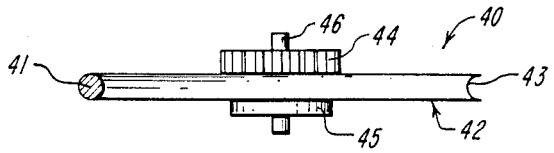
FIGS. 4A, 4B, 4C are plan views of a feeder line subassembly for the pen pack of FIG. 1.
Figure 4B:
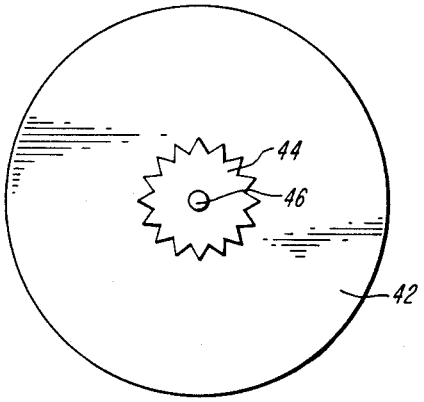
Figure 4C:
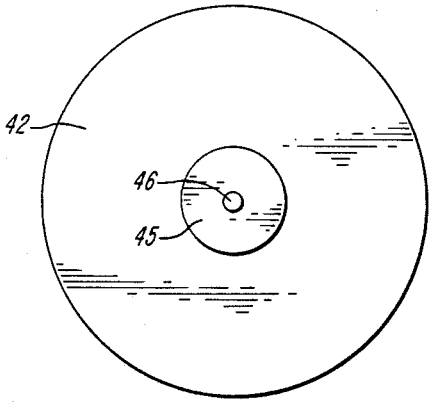
Figure 9:
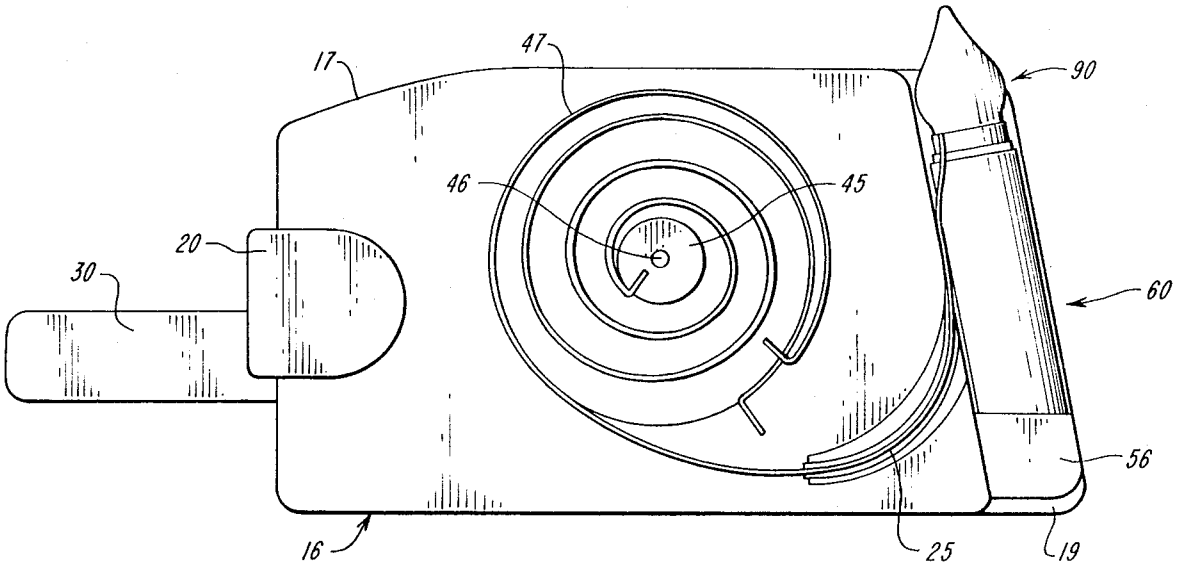
FIG. 9 is a plan view of the pen pack of FIG. 1 with the lower casing member removed.

Several plan views of the feeder line subassembly 40 are illustrated in FIGS. 4A, 4B, 4C. The feeder line subassembly 40 includes a feeder line 41, a feeder line wheel 42 having a concave edge 43, a feeder line gear 44, a retraction spring anchor 45, a feeder line wheel axle 46 and a retraction spring 47 (FIGS. 2, 9). The feeder line wheel 42, the feeder line gear 44, the retraction spring anchor 45 and the feeder line wheel axle 46 may be formed as an integral unit and may be formed from the same material as the casing 16.

The feeder line wheel 42 is mounted for rotational movement within the chamber 21 by disposing the ends of the axle 46 in the corresponding wells 22. The feeder line gear 44 of the mounted feeder line wheel 42 engages the teeth 32 of the plunger 30.

One end of the feeder line 41 is secured to the feeder line wheel 42 so that the feeder line 41 may be movably disposed in the space defined between the concave edge 43 of the feeder line wheel 42 and the feeder line groove 24 and extended out through the feeder line channel 25. The feeder line 41 may be formed from anY suitably stiff material such as nylon, hard impact plastic or metal which does not experience any appreciable changes in length when subjected to the extension and/or retraction forces which position the writing means 60 for use and nonuse. The feeder line channel 25 ensures that there is no binding on the feeder line 41, thereby ensuring proper extension/retraction of the writing means 60.

Referring to FIGS. 2 and 9, the retraction spring 47 has a helical configuration. One end of the retraction spring 47 is secured to the retraction spring anchor 45 and the other end is secured to the lower casing member 18 of the pen pack casing 16.

Figure 5B:
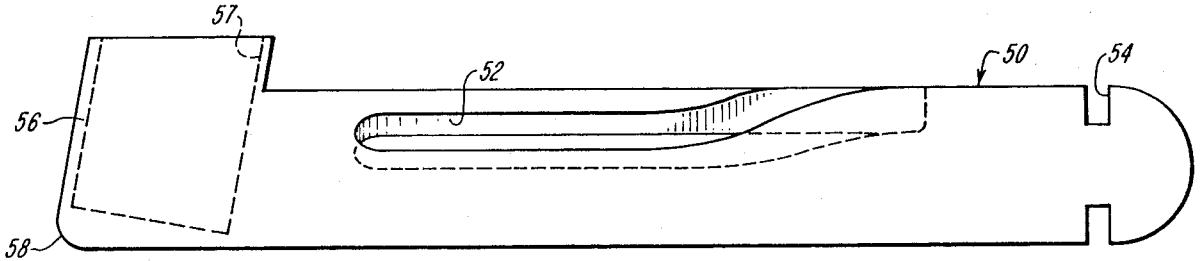
FIGS. 5A, 5B are plan views of a rotational shaft for the pen pack of FIG. 1.
Figure 5A:
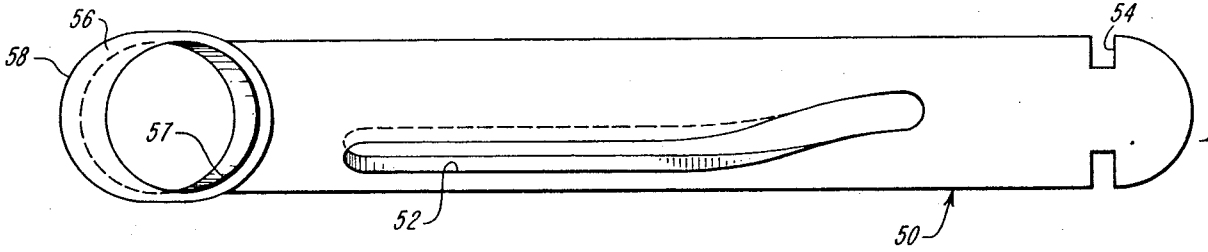

Two plan views of an exemplary rotational shaft 50 for use with the pen pack 10 of FIG. 1 are illustrated in FIGS. 5A, 5B. The rotational shaft 50 is an elongated, generally cylindrical shaft configured to be disposed within the cylindrical channel 23 for rotational movement.

The rotational shaft 50 has a plunger pin track 52 and a circular shaft retention groove 54 as illustrated. With the rotational shaft 50 disposed within the cylindrical channel 23, the pin 34 of the plunger 30 is seated within the track 52. The stop flange 26 of the cylindrical channel 23 is seated within the shaft retention groove 54 to prevent linear movement of the rotational shaft 50 when the plunger 30 is depressed.

A seat 56 for the writing means 60 is formed on the end of the rotational shaft 50 opposite the shaft retention groove 54. The seat 56 has a well 57 for securing the writing means 60 thereto and a rounded shoulder 58 opposite the open end of the well 57. The rounded shoulder 58 facilitates rotational movement of the shaft 50 caused by movement of the plunger pin 32 along the plunger pin track 52 due to depression of the plunger 30.

Plan views of the several components of an exemplary telescoping writing, marking or scribing means 60 are illustrated in FIGS. 6A, 6B, 6C, 6D. For purposes of describing the instant invention, the writing means 60 is depicted as a ballpoint-type pen. It is to be understood, however, that the term writing means is used in a broad sense to include various implements such as pencils, felt-tipped pens, crayons, paint brushes, grease pencils, styluses or the like which may be used for writing, marking and/or scribing.

The telescoping writing means 60 includes an outer casing 62, an intermediate casing 70, an inner casing 80 and a writing cartridge 90. The inner casing 80 is configured for nesting within the intermediate casing 70 and the combination of the inner and intermediate casings 80, 70 is configured for nesting within the immotile outer casing 62. The casings may be formed by a number of conventional fabrication techniques and may be formed from the same material as the pen pack casing 16.

Figure 6A:
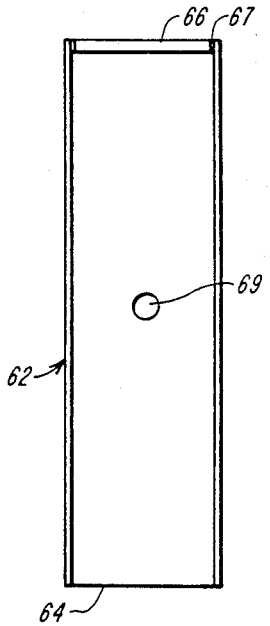
FIGS. 6A, 6B, 6C, 6D are plan views of an exemplary telescopic writing instrument for the pen pack illustrated in FIG. 1.
Figure 6B:
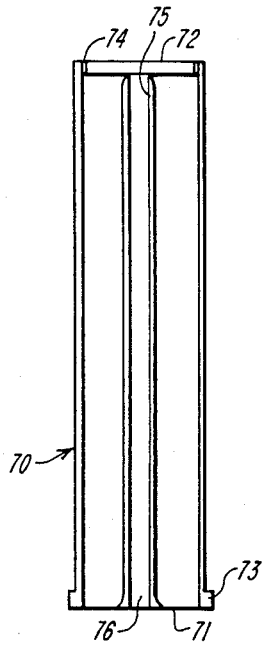
Figure 6C:
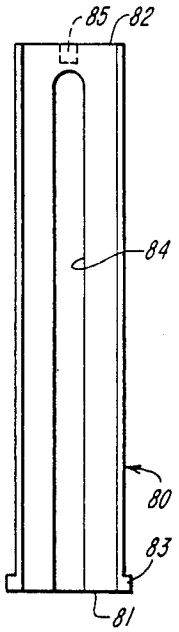
Figure 7D:
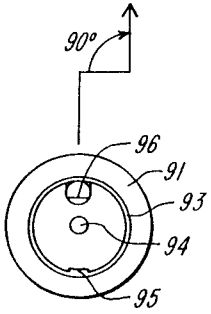
FIGS. 7A, 7B, 7C, 7D are corresponding cross-sectional views of the plan views of FIGS. 6A, 6B, 6C, 6D.

The outer casing 62 is a hollow cylindrical tube having first and second ends 64, 66. The first end 64 is secured within the well 57 of the marking means seat 56. An annular inner stop 67 is formed in the outer casing 62 at the second end 66. A male guide member 68, as shown in FIG. 7A, is formed within the outer casing 62 and extends in an axial direction from the first end 64 thereof to inner stop 67 at the second end 66. A feeder line hole 69 is formed through the outer casing 62 as illustrated in FIG. 6A.

The intermediate casing 70 is a hollow cylindrical tube having first and second ends 71, 72 and an outer diameter which permits telescoping movement of the intermediate casing 70 past the annular inner stop 67 of the outer casing 62. An annular outer stop 73 is formed at the first end 71 of the intermediate casing 70. The outer stop 73 is configured to engage the inner stop 67 of the outer casing 62 during linear movement of the intermediate casing 70 outwardly from the outer casing 62 to retain the intermediate casing 70 within the outer casing 62 during telescoping movement of the writing implement.

An annular inner stop 74 is formed at the second end 72 of the intermediate casing 70. A feeder line cutaway 75 is formed in the intermediate casing 70 extending in the axial direction from the first end 71 to approximately the inner stop 74 at the second end 72. A male guide member 76, also illustrated in FIG. 7B, is formed within the intermediate casing 70 opposite the feeder line cutaway 75 and extends in the axial direction from the first end 71 thereof to the annular inner stop 74 at the second end 72. A female guide slot 77, illustrated in FIG. 7B, is formed in the annular outer stop 73 of the intermediate casing 70 in alignment with the male guide member 76.

With the intermediate casing 70 nested within the outer casing 62, the male guide member 68 of the outer casing 62 is seated within the female guide slot 77 of the intermediate casing 70. This combination prevents relative rotational movement between the outer and intermediate casings 62, 70 during telescopic movement of the cartridge component.

The inner casing 80 is a hollow cylindrical tube having first and second ends 81, 82 and an outer diameter which permits linear movement into and out of the intermediate casing 70 past the annular inner stop 74 thereof. An annular outer stop 83 is formed at the first end 81 of the inner casing 80. The outer stop 83 is configured to engage the inner stop 74 of the intermediate casing 70 during linear movement of the inner casing 80 outwardly from the intermediate casing 70 to retain the inner casing 80 within the intermediate casing 62 during ejection of the marking component.

A feeder line cutaway 84 is formed in the inner casing 80 extending in the axial direction from the first end 81 to near the second end 72. A cartridge guide member 85 is formed in the second end 82 of the inner casing 80 in opposed relation to the feeder line cutaway 84. With the inner casing 80 nested within the intermediate casing 70, the feeder line cutaway 75 of the intermediate casing 70 is aligned superjacent the feeder line cutaway 84 of the inner casing 80.

Figure 7C:
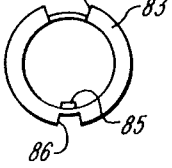
Figure 7B:
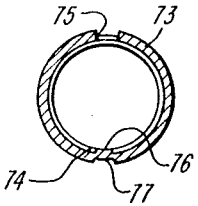
Figure 7A:
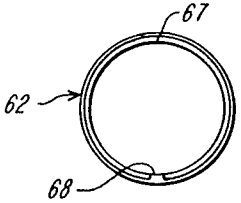

A female guide slot 86, illustrated in FIG. 7C, is formed in the annular outer stop 83 of the inner casing 80 opposite the feeder line cutaway 84. With the inner casing 80 nested within the intermediate casing 70, the male guide member 76 thereof is seated within the female guide slot 86 of the inner casing 80. This combination prevents relative rotational movement between the intermediate and inner casings 70, 80 during telescopic movement of the writing instrument.

Figure 6D:
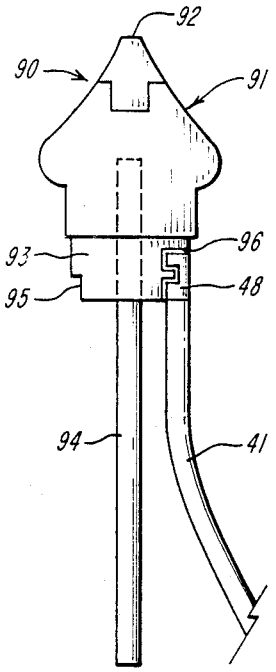

An exemplary writing cartridge 90 for use in the writing means 60 is illustrated in FIGS. 6D and 7D and for purposes of explication, is shown as a ballpoint-type pen. The writing cartridge 90 includes a cartridge head 91 having a small ball bearing 92 seated therein for rotational movement, a cartridge skirt 93 integrally formed with the cartridge head 91 and a coaxial cartridge ink well 94 containing a supply of writing fluid.

The bulbous configuration of the cartridge head 91 facilitates the positioning of the writing cartridge 90 for writing if the writing cartridge 90 is over extended during the telescoping operation. The small ball bearing 92 is seated within the cartridge ink well 94 such that rotational movement of the bearing 92 causes writing fluid to be supplied to the bearing 92.

A guide notch 95 is formed in the cartridge skirt 93. A feeder line seat 96 is also formed in the cartridge skirt 93 in opposed relation to the guide notch 95. A complementary feeder line retainer 48 is secured to the other end of the feeder line 41 as illustrated in FIG. 6D. The cartridge skirt 93 is configured to be inserted within the inner casing 80.

With the cartridge skirt 93 inserted within the inner casing 80, the cartridge guide member 85 of the inner casing 80 engages the guide notch 95 of the cartridge skirt 93 to maintain the marking cartridge 90 in combination with the inner casing 80 during telescoping movement. The inner surface of the inner casing 80 presses against the feeder line retainer 48, thereby maintaining the feeder line retainer 48 in combination with the feeder line seat 96. With the casings nested as described above and the cartridge skirt 93 inserted within the inner casing 80, the feeder line 41 passes through the feeder line hole 69 and the feeder line cutaways 75, 84 of the outer, intermediate and inner casings 62, 70, 80, respectively.

As will be appreciated from the immediately preceding discussion, the writing cartridge 90 may be readily replaced when the writing fluid is depleted. It will also be appreciated that the writing cartridge 90 may be readily removed so that different types of writing, marking or scribing means may be used. This greatly enhances the utility of the pen pack according to the present invention since the pen pack may be readily reconfigured to facilitate different writing, marking or scribing operations by changing the cartridge 90.

The pen pack 10 as described hereinabove is shown in assembled configuration in FIGS. 8 and 9 with the upper and lower casing members 17, 18, respectively, removed. The structural interrelationships between the various components as described hereinabove may be more readily appreciated by reference to these drawings. The writing means 60, which is protected by the shield 19, is disposed in a plane generally coplanar to the back of the wearer's hand.

Figure 10:
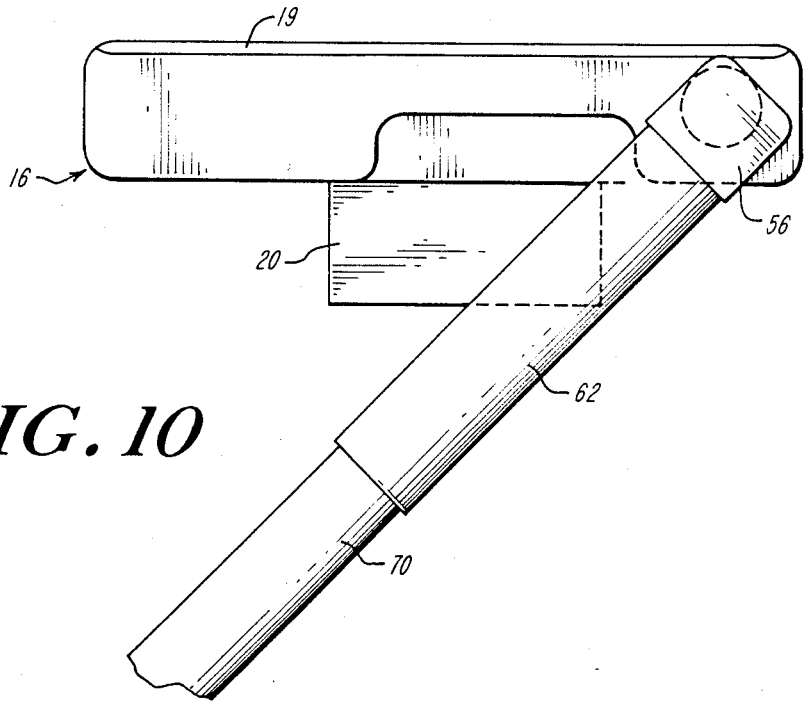
FIG. 10 is a side view of the pen pack of FIG. 1 with the plunger depressed illustrating the telescopic writing instrument in the writing position.

The functional relationship between the structural components of the pen pack 10 may also be more fully appreciated by referring to these drawings and FIG. 10. The pen pack 10, mounted on the back of the writing hand of the user, is activated by the wearer pressing the outwardly extending end of the plunger 30 against any convenient external object. The depression of the plunger 30 causes linear movement thereof in direction A.

Movement of the plunger 30 in direction A causes corresponding simultaneous reactive movements of the feeder line subassembly 40 and the rotational shaft 50. The linear movement of the plunger 30 causes the plunger pin 34 to traverse along the plunger pin track 52, thereby causing the rotational shaft 50 to be rotated in a counterclockwise direction. With reference to FIG. 10, this causes the writing means seat 56 to be rotated downwardly such that the telescoping marking means 60 is brought into close proximity or contact with the thumb of the wearer, i.e., into a writing position.

Figure 8:
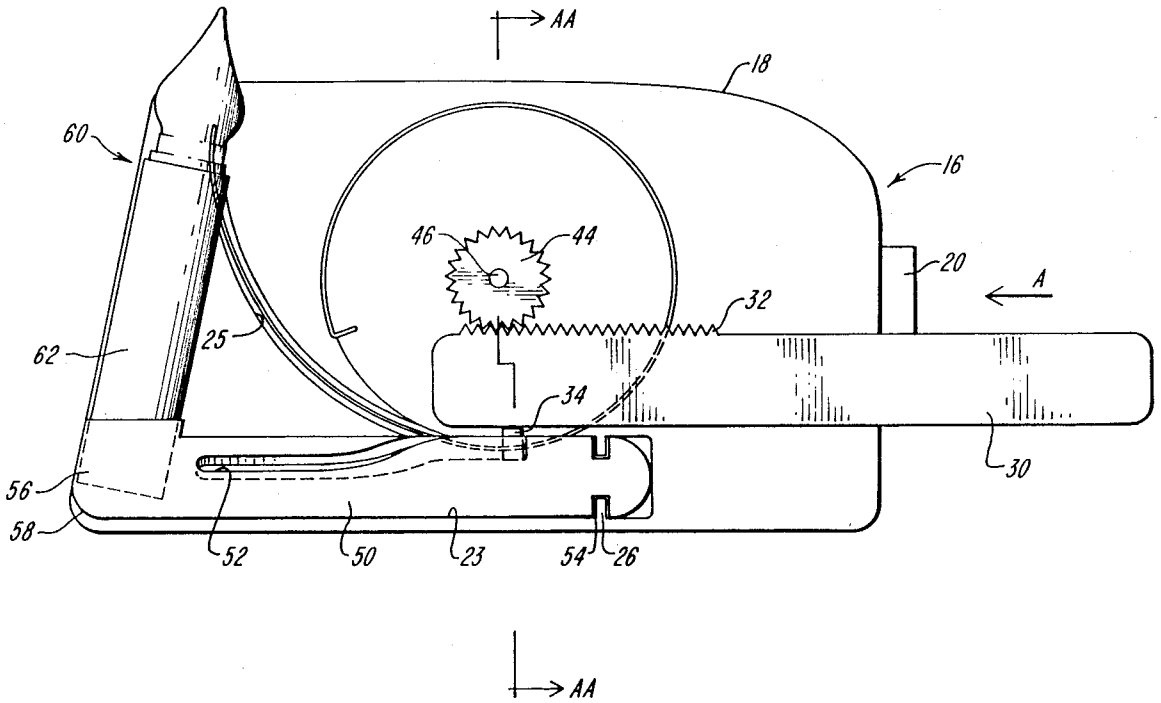
FIG. 8 is a plan view of the pen pack of FIG. 1 with the upper casing member removed.

Since the plunger teeth 32 and the feeder line gear 44 are engaged, movement of the plunger 30 concomitantly causes the feeder line wheel 42 to be rotated in a clockwise direction, as viewed in FIG. 8. The clockwise rotation of the wheel 42 causes the retraction spring 47 to be compressed.

Concomitantly, the clockwise rotation of the feeder line wheel 42 causes the feeder line 41 to be pushed outwardly. Since other end of the feeder line 41 is disposed in combination with the writing cartridge 90, the writing cartridge 90 telescopes outwardly from the writing means seat 56 to bring inner casing 80 into a position wherein the wearer may grip it by means of the thumbs and first two fingers. The wearer maintains the writing means 60 in the position of use by exerting a small amount of pressure against the inner casing 80.

Thereafter, the wearer may utilize the writing means 60 for writing, marking or scribing as desired. When the wearer has finished with the writing means 60, the pressure being maintained against the inner casing 80 is simply released. The biasing force exerted by the retraction spring 47 causes the feeder line wheel 42 to be rotated in a counterclockwise direction, causing the feeder line 41 to be retracted and the plunger 30 to be moved linearly in the direction opposite direction A.

Retraction of the feeder line 41 causes the inner and intermediate casings 80, 70 to be retracted, thereby removing the writing cartridge 90 from the wearer's grip. Movement of the plunger 30 causes a clockwise rotation of the rotation shaft 50 such that the writing means 60 is rotated upwardly into the position coplanar with the back of the user's hand, i.e., a position of nonuse. In this position, both of the wearer's hands are free for use in performing non-writing tasks.

As shown in several of the figures, the ball bearing 92 of the cartridge head 91 is disposed coaxially to the axis of the writing cartridge 90. To facilitate writing, marking or scribing, the ball bearing 92 may be canted slightly off-axis to facilitate writing, marking or scribing.

Figure 11A:
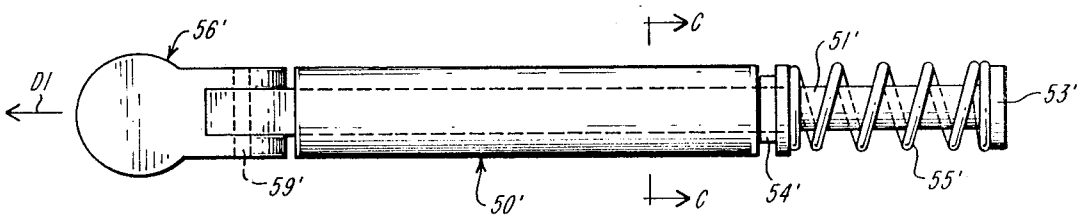
FIGS. 11A, 11B are plan views of an alternative embodiment of a rotational shaft for a pen pack according to the present invention.
Figure 11B:
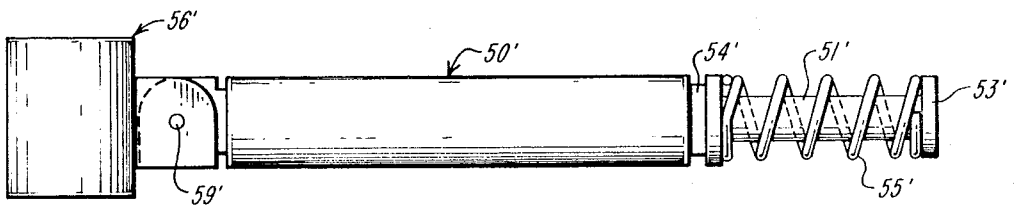
Figure 11C:
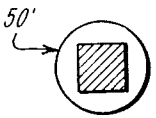
FIG. 11C is a cross-sectional view of the rotational shaft of FIG. 11A taken along line C—C.

An alternative embodiment of a rotational shaft 50' for use in the pen pack 10 of FIG. 1 is illustrated in FIGS. 11A, 11B, 11C. The rotational shaft 50' is an elongated, hollow, generally cylindrical shaft configured to be disposed within the cylindrical channel 23 for rotational movement.

The rotational shaft 50' includes a plunger pin track (not shown) similar to the one formed in the rotational shaft 50 illustrated in FIGS. 5A, 5B, and a circular shaft retention groove 54'. An extension shaft 51', configured so that it cannot rotate within the hollow rotational shaft 50', is disposed within the rotational shaft 50' and extends outwardly of the ends thereof as shown. The end of the extension shaft 51' adjacent the retention groove 54' has a butt plate 53' formed thereon. An extension return spring 55' is disposed about the extension shaft 51' and abuts against the end of the rotational shaft 50' and the butt plate 53'.

A writing means seat 56 is attached to the other end of the extension shaft 51' by means of a pivot pin 59. This combination of elements permits the writing means seat 56' to be moved linearly outward along the axis of the rotational shaft 50', in the direction D1, such that the fixed end of the writing means 60 may be moved outwardly from the pen pack casing 16 for writing, marking or scribing. The pivoting attachment of the writing seat means 56 permits the writing cartridge 90 to move inwardly towards the fingers to facilitate writing, marking or scribing.

A variety of modifications and variations of the present invention are possible in light of the above teachings. For example, the telescoping writing means may be formed with more or less than three casing members. The plunger may be activated by an electric or pneumatic switch means instead of being depressed 12 through movement of the user's hand. In addition to the shield, a cowling may be formed integrally with the casing to protect the telescoping writing means. It is therefore to be understood that within the scope of the appended claims, the present invention may be practiced otherwise than as specifically described hereinabove.

What is claimed is:

1. A pen pack for mounting on a hand of a user to provide ready access to a writing implement, comprising:

a pen pack casing configured to define a predetermined internal volume;

means affixed to said pen pack casing for mounting said pen pack casing on the back of the hand of the user;

a telescopic writing means for writing, said telescopic writing means including a writing implement; and mechanical means mounted in said predetermined internal volume of said pen pack casing to interact with said telescopic writing means for actuating said pen pack to automatically rotate said telescopic writing means from a position of nonuse into a writing position with respect to the hand of the user and for automatically and simultaneously telescoping said telescopic writing means to an extended position so that the user may grip said writing implement and utilize said writing implement for writing.

2. The pen pack of claim 1 wherein said actuating means further comprises:

means for automatically retracting said telescopic writing means for the writing position to the position of nonuse upon release of said writing implement by the user.

3. The pen pack of claim 1 wherein said telescopic writing means comprises:

outer casing means affixed at one end to said mechanical actuating means for automatically rotating said writing implement from the position of nonuse into the writing position with respect to the hand of the user upon actuation of said mechanical actuating means;

intermediate casing means configured for nesting within said outer casing means and for telescoping movement relative thereto;

inner casing means configured for nesting within said intermediate casing means and for telescoping movement relative thereto; and said writing implement that includes means for securing said writing implement to said inner casing means, and means for mechanically coupling said writing implement to said actuating means wherein said actuating means can automatically telescope said writing implement to the extended position upon actuation of said mechanical actuating means so that the user may grip said writing implement and utilize said writing implement for writing.

4. The pen pack of claim 1 wherein said mechanical actuating means comprises:

plunger means configured for linear movement and mounted in said predetermined internal volume of said pen pack casing for activating said pen pack to automatically rotate said telescopic writing means for the position of nonuse into the writing position with respect to the hand of the user and to simultaneously and automatically telescope said telescopic writing means to the extended position so that the user may grip said writing implement and utilize said writing implement for writing, said plunger means having an end extending outwardly from said pen pack casing;

rotational shaft means configured for rotational movement and mounted in said predetermined internal volume of said pen pack casing to coact with said plunger means for automatically rotating said telescopic writing means from the position of nonuse into the writing position with respect to the hand of the user; and feeder line subassembly means configured for rotational movement and mounted in said predetermined internal volume of said pen pack casing to coact, with said plunger means for simultaneously and automatically causing said telescopic writing means to be telescoped to the extended position to that the user may grip said writing implement and utilize said writing implement for writing;

wherein said pen pack is automatically activated by the user depressing said end of said plunger means extending outwardly from said pen pack casing.

5. The pen pack casing of claim 4 wherein said automatic retracting means comprises spring means in combination with said feeder line subassembly means for providing a biasing force to automatically retract said telescopic writing means from the writing position to the position of nonuse open release of said writing implement by the user, said biasing force being stored in said spring means by the user depressing said end of said plunger means extending outwardly from said pen pack casing.

6. The pen pack casing of claim 4 wherein said plunger means comprises:

an elongated member having first and second ends;

a plurality of teeth integrally formed on said first end of said elongated member; and a plunger pin integrally formed on said first end of said elongated member;

said second end of said elongated member extending, outwardly from said pen pack casing to permit activation of said pen pack by the user depressing said second end of said plunger;

said first end of said elongated member being mounted within said predetermined internal volume of said pen pack casing for linear movement therein wherein said plurality of teeth of said elongated member coact with said feeder line subassembly means to cause rotational movement of said feeder line subassembly means wherein said telescopic writing means is automatically telescoped to the extended position and said plunger pin interacts with said rotational shaft means to cause rotational movement of said rotational shaft means wherein said said telescopic writing means is automatically rotated into the writing position.

7. The pen pack of claim 1 wherein said pen pack casing includes a retainer integrally formed therewith and depending outwardly therefrom to engage the edge of the hand to preclude movement of said pen pack during operation of said actuating means.

8. The pen pack of claim 1 wherein said pen pack casing includes a shield integrally formed therewith depending outwardly therefrom to protect said telescopic writing means from damage when the user is using his hands for other tasks.

9. A pen pack for mounting on a hand of a user to provide ready access to a writing implement, comprising:

a pen pack casing;

means affixed to said pen pack casing for mounting said pen pack casing on the back of the hand of the user;

a telescopic writing means for writing, said telescopic writing means including a writing implement; and means housing in said pen pack casing to interact with said telescopic writing means for actuating said telescopic writing instrument to rotate said telescopic writing means from a position of nonuse into a writing position with respect to the hand of the user and for telescoping said telescopic writing means to an extended position so that the user may grip said writing, implement and utilize said writing implement for writing, said actuator means including plunger means configured for linear movement housed in said pen pack casing for activating said pen pack to rotate said telescopic writing means from a position of nonuse into a writing position with respect to the hand of the user and to telescope said telescopic writing means to an extended position so that the user may grip said writing implement and utilize said writing implement for writing, said plunger means having an end extending outwardly from said pen pack casing wherein said pen pack is activated by the user depressing said end of said plunger means extending outwardly from said pen pack casing, feeder line subassembly means configured for rotational movement housed in said pen pack casing to coact with said plunger means for rotating said telescopic writing means from a position of nonuse into a writing position with respect to the hand of the user, includes a feeder line wheel having first and second sides and a concave edge housing within said pen pack casing, said feeder line wheel including an axle integrally formed to depend outwardly from said first and second sides of said feeder line wheel to mount said feeder line wheel for rotational movement within said pen pack casing, a feeder line gear integrally formed on said first side of said feeder line wheel, said feeder line gear coacting with said plunger means to cause said telescopic writing means to be telescoped to an extended position so that the user may grip said writing implement and utilize said writing implement for writing, and feeder line disposed in said concave edge of said feeder line wheel and coupled to said writing implement to telescope said telescopic writing means to an extended position so that the user may grip said writing implement and utilize said writing implement for writing; and rotational shaft means configured for rotational movement housed in said pen pack casing to coact with said plunger means or causing said telescopic writing means to be telescoped to an extended position so that the user may grip said writing implement and utilize said writing implement for writing.

10. The pen pack of claim 9 wherein said feeder line subassembly further comprises retraction spring anchor integrally formed on the second side of said feeder line wheel; and a retraction spring having first and second ends, said first end of said retraction spring being secured to said retraction spring anchor and said second end of said retraction spring being secured to said pen pack casing;

wherein depression of said end of said plunger means causes a biasing force to be stored in said retraction spring, said biasing force causing said writing implement to be retracted to the nonuse position upon release of said writing implement by the user.

feeder line disposed in said concave edge of said feeder line wheel and coupled to said writing implement to telescope said telescopic writing means to an extended position so that the user may grip said writing implement and utilize said writing implement for writing; and rotational shaft means configured for rotational movement housed in said pen pack casing to coact with said plunger means for causing said telescopic writing means to be telescoped to an extended position so that the user may grip said writing implement and utilize said writing implement for writing.

11. A pen pack for mounting on a hand of a user to provide ready access to a writing implement, comprising;

a pen pack casing;

means affixed to said pen pack casing for mounting said pen pack casing on the back of the hand of the user;

a telescopic writing means for writing, said telescopic writing means including a writing implement; and means housing in said pen pack casing to interact with said telescopic writing means for actuating said telescopic writing instrument to rotate said telescopic writing means from a position of nonuse into a writing position with respect to the hand of the user and for telescoping said telescopic writing means to an extended position so that the user may grip said writing implement and utilize said writing implement for writing, said actuator means including plunger means configured for linear movement housing in said pen pack casing for activating said pen pack to rotate said telescopic writing means from a position of nonuse into a writing position with respect to the hand of the user and to telescope said telescopic writing means to an extended position so that the user may grip writing implement and utilize said writing implement for writing, said plunger means having an end extending outwardly from said pen pack casing wherein said pen pack is activated by the user depression said end of said plunger means extending outwardly from said pen pack casing, feeder line subassembly means configured for rotational movement housed in said pen pack casing to coact with said plunger means for rotating said telescopic writing means from a position of nonuse into a writing position with respect to the hand of the user, and rotational shaft means configured for rotational movement housing in said pen pack casing to coact with said plunger means for causing said telescopic writing means to be telescoped to an extended position so that the user may grip said writing implement and utilize said writing implement for writing, said rotational shaft means including an elongated cylindrical member having first and second ends and a plunger pin track formed therein, said first end of said cylindrical member having a shaft retention groove formed therein to coact with said pen pack casing to prevent linear movement of said cylindrical member and said second end having a seat for securing said telescopic writing means to said open pack, said plunger pin track coacting with said plunger means to rotate said cylindrical member upon depression of said end of said plunger means by the user, wherein said telescopic writing means is rotated from the position of nonuse into the writing position.

12. A pen pack for mounting on a hand of a user to provide ready access to a writing implement, comprising:

a pen pack casing;

means affixed to said pen pack casing for mounting said pen pack casing on the back of the hand of the user;

a telescopic writing means for writing, said telescopic writing means including a writing inplement; and means housed in said pen pack casing to interact with said telescopic writing means for actuating said telescopic writing instrument to rotate said telescopic writing means from a position of nonuse into a writing position with respect to the hand of the user and for telescoping said telescopic writing means to an extended position so that the user may grip said writing implement and utilizing said writing implement for writing, said actuator means including plunger, means configured for linear movement housed in said pen pack casing for activating said pen pack to rotate said telescopic writing means from a position of nonuse into a writing position with respect to the hand of the user and to telescope said telescopic writing means to an extended position so that the user may grip said writing implement and utilize said writing implement for writing, said plunger means having an end extending outwardly from said pen pack casing wherein said pen pack is activated by the user depressing said end of said plunger means extending outwardly from said pen pack casing, feeder line subassembly means configured for rotational movement housed in said pen pack casing to coact with said plunger means for rotating said telescopic writing means from a position of nonuse into a writing position with respect to the hand of the user, and rotational shaft means configured for rotational movement housed in said pen pack casing to coact with said plunger means for causing said telescopic writing means to be telescoped to an extended position so that the user may grip said writing implement and utilize said writing implement for writing, said rotational shaft means including an elongated hollow cylindrical member having first and second ends and a plunger pin track formed therein, said first end of said hollow cylindrical member having a shaft retention groove formed therein to coact with said pen pack casing to prevent linear movement of said hollow cylindrical member, an extension shaft configured for disposition within said hollow cylindrical member, said extension shaft having first and second ends extending beyond said first and second ends of said hollow cylindrical member, said first end of said extension shaft having a butt place integrally formed therewith, an extension return spring disposed about said extension shaft to abut said butt plate and said first end of said hollow cylindrical shaft, a seat for securing said telescoping writing means to said pen pack pivotally attached to said second end of said extension shaft, and said plunger pin track coacting with said plunger means to rotate said hollow cylindrical member upon depression of said end of said plunger means by the user, wherein said telescopic writing means is rotated from the position of nonuse into the writing position and wherein said pivotally attached seat permits said writing implement to be moved inwardly towards the fingers of the hand to facilitate writing.

* * * * *

UNITED STATES PATENT AND TRADEMARK OFFICE

CERTIFICATE OF CORRECTION

PATENT NO. : 4,951,856

DATED : August 28, 1990

INVENTOR(S) : Gary A. Horgan

It is certified that error appears in the above-identified patent and that said Letters Patent is hereby corrected as shown below:

Column 8, line 12, "pivot pin 59" should read --pivot pin 59'--.
Column 8, line 19, "56" should read --56'--.
Column 8, line 27, "depressed 12" should read --depressed--.
Column 9, line 26, "for the position" should read --from the position--.
Column 9, line 57, "open" should read --upon--.
Column 10, line 37, "means housing" should read --means housed--.
Column 10, line 65, "the user, includes" should read --the user, said feeder line subassembly means includes--.
Column 10, line 67, "edge housing" should read --edge housed--.
Column 11, line 20, "means or causing" should read --means for causing--.
Column 11, line 27, "retraction spring" should read --a retraction spring--.
Column 11, line 39-51, delete the text beginning with "feeder line disposed with .... and ending with, implement for writing."
Column 11, line 61, "means housing" should read --means housed--.
Column 12, line 51, "inplement" should read --implement--.
Column 12, line 59, "utilizing" should read --utilize--.
Column 12, line 62, "plunger," should read --plunger--.
Column 12, line 3/4, "housing" should read --housed--.
Column 12, line 36, "open pack" should read --pen pack--.

Signed and Sealed this

Twenty-eighth Day of July, 1992

*Attest:*

DOUGLAS B. COMER

*Attesting Officer*

*Acting Commissioner of Patents and Trademarks*